United States Patent [19]

Ogino

[11] 4,426,547

[45] Jan. 17, 1984

[54] GAS-FILLED INSULATING BUSHING HAVING CHAMBERS SEPARATED BY AN INSULATING PARTITION

[75] Inventor: Toyohisa Ogino, Okazaki, Japan

[73] Assignee: NGK Insulators, Ltd., Nagoya, Japan

[21] Appl. No.: 277,004

[22] Filed: Jun. 24, 1981

[30] Foreign Application Priority Data

Jul. 3, 1980 [JP] Japan ..... 55-92844

[51] Int. Cl.[3] ..... H01B 17/26; H01B 17/36

[52] U.S. Cl. ..... 174/31 R; 174/142

[58] Field of Search ..... 174/11 BH, 12 BH, 15 BH, 174/16 BH, 18, 31 R, 142, 143, 152 R

[56] References Cited

U.S. PATENT DOCUMENTS 3,242,251 3/1966 Floessel ..... 174/31 R X

FOREIGN PATENT DOCUMENTS 2210289 9/1973 Fed. Rep. of Germany .. 174/15 BH

*Primary Examiner*—Laramie E. Askin

*Attorney, Agent, or Firm*—Parkhurst & Oliff

[57] ABSTRACT

A gas-filled insulating bushing includes a center conductor and a porcelain tube enclosing therein an insulating gas. A tubular insulating partition is arranged adjacent to an inner wall of the porcelain tube to define the space therein into two spaces communicated with each other through small diameter vents so as to eliminate pressure differences between the spaces, thereby making lower a back pressure in explosion to suppress scattering of fragments of the porcelain tube and hence prevent neighboring instruments from being damaged.

4 Claims, 3 Drawing Figures

GAS-FILLED INSULATING BUSHING HAVING CHAMBERS SEPARATED BY AN INSULATING PARTITION

BACKGROUND OF THE INVENTION

1. Field of the Invention

The present invention relates to a gas-filled insulating bushing and more particularly to a gas-filled insulating bushing which is superior in safety and capable of preventing fragments of a porcelain tube from widely flying or scattering when it is exploded by a dielectric breakdown in the air.

2. Description of the Prior Art

In general, as sulfur hexafluoride gas ($SF_6$ gas) is superior in arc suppressing capacity and insulating performance, it has been widely used for gas-filled circuit breakers or gas-filled insulating switching devices. Particularly, it has been used in bushings at the outputs of such devices. In this case, as shown in FIG. 1, a center conductor 1 is surrounded by a porcelain tube 2 whose inner cavity is sealingly filled with a gas in an air tight manner. The gas pressure in the bushing is usually 2–5 $kg/cm^2g$ which provides a sufficient safety factor for the breaking down pressure of the porcelain tube under usual operating conditions. However, when the porcelain tube is damaged due to collision of foreign matter or flashing of the tube by extraordinary voltage, fragments of the tube would widely scatter due to the gas pressure in the tube and would further break instruments or equipment neighboring the bushing.

In order to avoid such an occurrence, a prior art gas-filled insulating bushing as shown in FIG. 2 has been proposed, wherein a thick tubular insulating partition 15 consisting of a glass fiber or glass cloth and a thermosetting synthetic resin integrally set therewith is arranged centrally about a center conductor 1 in a porcelain tube 2 to divide a cavity in the tube into two chambers, one in the insulating partition 15 for accommodating the greater part of the inner pressure of the bushing and the other outer chamber between the insulating partition 15 and the porcelain tube 2 for receiving a gas in the order of the atmospheric pressure, thereby preventing an explosion of the porcelain tube.

With such an arrangement including the insulating partition supporting the greater part of the inner pressure, however, a large and high strength insulating partition is required for high voltage. The larger the insulating partition, the more difficult it is to obtain a partition stable in strength. Moreover, greater and more complicated procedures are required for manufacturing such insulating partitions, so that the partitions obtained become expensive. In addition, the increased weight of the insulating partition requires a much firmer mounting portion thereof and the bushing itself becomes larger.

On the other hand, disasters caused by the scattered fragments of porcelain tubes damaged due to flashing of an instrument have become serious because the voltages used in systems have been going higher and higher. Under these circumstances, it has been necessary to develop gas-filled insulating bushings which are simple in construction and capable of preventing fragments of porcelain tubes from widely scattering even if the tubes are damaged due to flashing.

SUMMARY OF THE INVENTION

A primary object of the present invention is to provide an improved gas-filled insulating bushing which solves the above mentioned problems seen in the prior art.

A gas-filled insulating bushing including a center conductor and including a porcelain tube enclosing therein an insulating gas according to the invention comprises a tubular electrical insulating partition surrounding the center conductor and located adjacent to an inner wall of the porcelain tube to define gas spaces therein which are communicated with each other through small diameter vents.

In order that the invention may be more clearly understood, preferred embodiments will be described, by way of example, with reference to the accompanying drawings.

DETAILED DESCRIPTION OF THE PREFERRED EMBODIMENT

Figure 1:
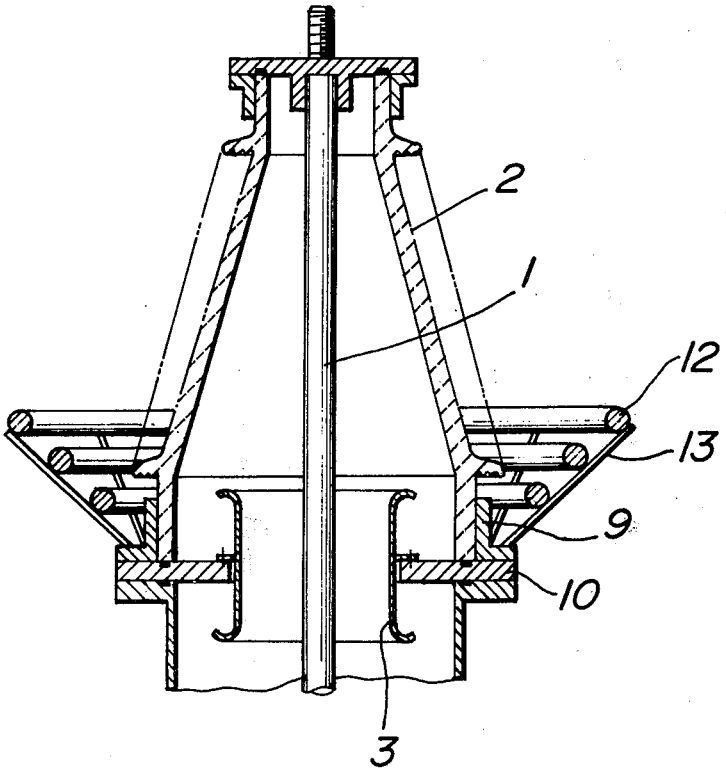
FIG. 1 PRIOR ART
FIG. 1 is a sectional view of a gas-filled insulating bushing of the prior art as mentioned above.
Figure 2:
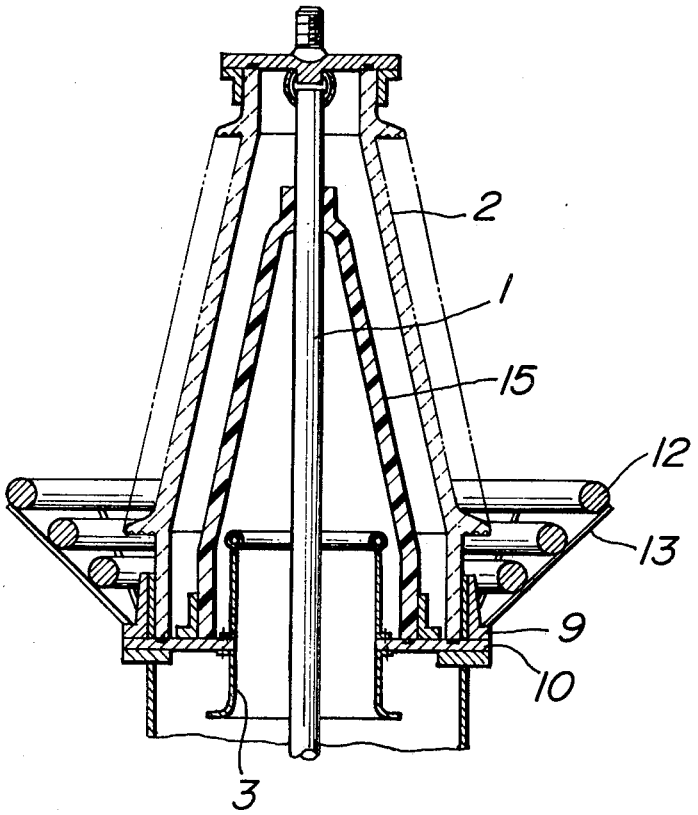
FIG. 2 PRIOR ART
FIG. 2 is a sectional view of another gas-filled insulating bushing of the prior art as mentioned above.
Figure 3:
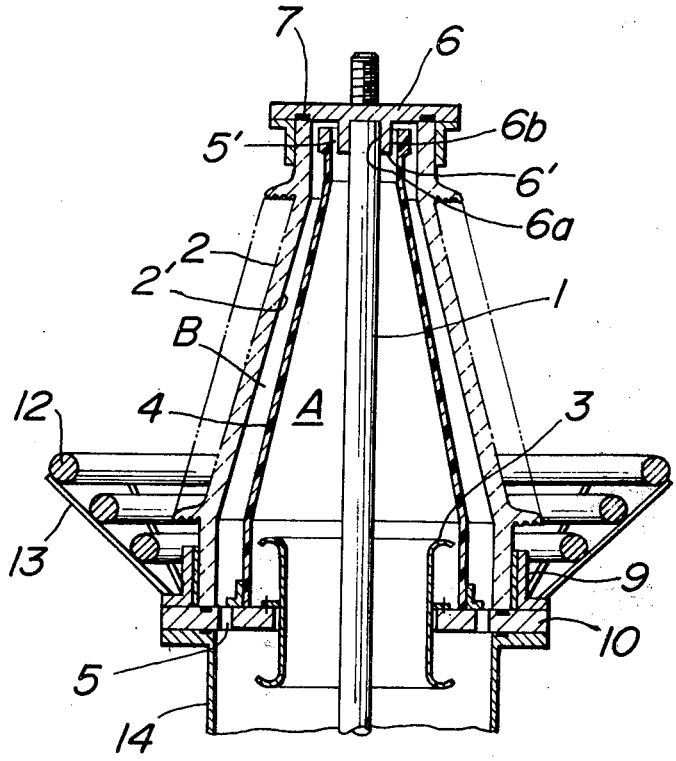
FIG. 3 is an explanatory sectional view of one embodiment of a gas-filled insulating bushing according to the present invention.

Referring to FIG. 3, illustrating a preferred embodiment of the invention wherein the same reference numerals have been utilized to identify like parts in FIGS. 1 and 2, a center conductor 1 is inserted through a porcelain tube 2 whose upper portion is sealed in an air tight manner with a packing 7 by means of an upper fitting 6 including at the center of its lower surface a protruded holder 6' extending therefrom and provided on its inner side with a socket *6a* for the center conductor 1 and on its outer side with a smooth slide surface *6b*. An upper end of the center conductor 1 is fitted and held in the socket *6a* of the holder 6'. Adjacent to an inner wall 2' of the porcelain tube 2 between the center conductor 1 and the porcelain tube 2 is arranged an insulating partition 4 having one end fixed to an earth flange 10 connected to a fixture 9 and the other end slidably fitted on the slide surface *6b* of the holder 6' extending from the upper fitting 6.

The insulating partition 4, usually made of a thin synthetic resin, defines gas spaces A and B between the center conductor 1 and the inner wall 2' of the porcelain tube 2. The insulating partition 4 is made tubular so as to surround the center conductor 1 and an earth shield 3, and forms at its upper end a suitable clearance 5' with the slide surface *6b* which makes it possible to expand in an axial direction due to thermal expansion and contraction. As an alternative, the porcelain tube 2, the fixture 9 and the insulating partition 4 may be formed so as to provide this clearance at the lower end of the insulating partition 4.

Moreover, it is preferable to arrange the insulating partition 4 adjacent to the inner wall 2' of the porcelain tube 2 as close as possible, because a gas contained in the space B is small in volume, so that fragments of the porcelain tube scatter only within a narrow area in case of damage to the porcelain tube. In this manner, the insulating partition 4 defines between the center conductor 1 and the porcelain tube 2 the respective independent spaces A and B which are communicated with each other through vents 5 formed in, for example, the earth flange 10 so as to normally eliminate a pressure difference between the spaces A and B.

Air earth shields 12 are fixed to the earth flange 10 by means of support pipes 13. A metal casing 14 of, for example, a gas-filled circuit breaker supports the bushing through the earth flange 10.

With this arrangement, the insulating partition 4 according to the invention is not required to resist pressure differences between the spaces A and B, which would otherwise occur as seen in the prior art. Accordingly, the insulating partition 4 can be made thin and in an extreme case it may be made of an elastic insulating material such as rubber. The size of the vents 5 for communicating the gas spaces A and B is to be generally determined such that gases derived from broken portions are not easily fed from the space A to the space B through the vents 5, although depending substantially upon insulating ratings of the bushings. For example, 10–20 mm diameters of the vents are preferable for 500 kv.

Although in the above embodiment the suitable number of vents 5 are shown formed in the earth flange, the invention is not limited to such a feature. For example, the vents may be formed in the insulating partition 4 itself. The positions and numbers of the vents are not limited so long as they serve to communicate the spaces A and B to keep constant the pressure difference therebetween under normal conditions.

With the bushing constructed in such a manner, when the porcelain tube 2 is broken, the gas pressure in the space B opens into the air and simultaneously falls to a lower pressure, so that the gas pressure in the space A is supplied to the space B through the vents 5 to equalize the pressures in the spaces A and B. If the vents 5 are so arranged as to increase its flow resistance, the supply of the gas from the space A to the space B does not follow the pressure decrease in the space B, with the result that only the pressure in the narrowed space B as a back pressure scatters the fragments of the porcelain tube, thereby restraining the scattering of the fragments within a minimum area. In this case, the insulating partition is subjected to the pressure in the space A for a short period of time. As it is a very short time, such as less than one tenth of one second, and the pressure in the space A is progressively exhausted and falls to a lower value, the thickness of the wall of the insulating partition can be thin under these conditions.

As above mentioned, the positions of the vents are not necessarily limited to those shown in the embodiments, but the uppermost positions in the insulating partition are preferable.

Moreover, it is preferable to arrange the clearance permitting the thermal expansion of the partition at its upper end, such that the clearance also simultaneously serves as the vents.

With the insulating partition constructed in this manner, the scattering of fragmentations of a porcelain tube can be limited within a minimum area as above described. In this case, the gas in the space A flows out of the space in succession. As the density of the gas is higher than that of the air, the gas does not completely flow out of the space A, so that the bushing can maintain its performance of an insulating bushing for a certain period of time. The gas-filled insulating bushing according to the present invention, therefore, has a remarkable advantage in that even if a porcelain tube is damaged, the fact that the performance of the insulating bushing is kept for a certain period of time ensures a sufficient time to effect necessary steps for normally maintaining a transmission system and a distribution line.

Moreover, when a flashing occurs in the bushing, it will be evident that the insulating partition 4 and the vents 5 impede the transmission of increasing pressure in the space A to the space B to reduce the risk of an explosion of the porcelain tube caused by its inner pressure.

As can be seen from the above description, the gas-filled insulating bushing according to the present invention comprises an insulating partition defining gas spaces A and B which are communicated with each other through vents to normally eliminate pressure differences between the spaces, thereby reducing the volume of the gas under pressure as a back pressure. The gas under pressure functions as a back pressure in an explosion, thereby reducing the area within which fragments of a porcelain tube scatter, and hence preventing neighboring instruments and equipment from being damaged by the scattered fragments. The gas-filled insulating bushing according to the present invention achieves an equalization of pressures in the spaces A and B, thereby permitting use of a thin insulating partition so that a bushing which is small and light weight and inexpensive to manufacture and which makes a remarkable contribution as an industrial improvement is obtained.

It is further understood by those skilled in the art that the foregoing description is directed to preferred embodiments of the disclosed bushings and that various changes and modifications may be made in the invention without departing from the spirit and scope thereof.

What is claimed is:

1. A gas-filled insulating bushing including a center conductor and including a porcelain tube enclosing therein a pressurized insulating gas, said bushing comprising a tubular electrical insulating partition, of such thickness that it can only withstand the full internal gas pressure of said pressurized gas in said insulating bushing in the absence of said porcelain tube for approximately 1/10 of one second, surrounding said center conductor and dividing the gas space in said porcelain tube into two spaces, one between said porcelain tube and said partition and the other between said partition and said center conductor, said partition being located adjacent to an inner wall of said porcelain tube, and said spaces being communicated with each other through small diameter vents, said vents being so small as to inhibit but not prevent entirely flow of said pressurized gas therethrough, so that the gas pressure in the space between said partition and said center conductor is supplied to the space between said partition and said porcelain tube through said small diameter vents to equalize the pressure in both said spaces, whereby when said porcelain tube is broken the gas pressure in the space between said partition and said porcelain tube opens into the air and simultaneously falls to a lower pressure and scattering of fragments of said broken porcelain tube is thus minimized.

2. A gas-filled insulating bushing as set forth in claim 1, wherein said insulating gas is sulfur hexafluoride gas and said small diameter vents are provided only at the uppermost portion of said partition.

3. A gas-filled insulating bushing as set forth in claim 1 or 2, wherein one end of said tubular partition is slidably movable.

4. A gas-filled insulating bushing as set forth in claim 3, wherein the other end of said tubular partition is stationary and said movable end of said tubular partition forms a part of said small diameter vents.

* * * * *